US010167560B2

(12) United States Patent
Guo et al.

(10) Patent No.: US 10,167,560 B2
(45) Date of Patent: Jan. 1, 2019

(54) METHOD AND APPARATUS FOR STRUCTURAL COLORATION OF METALLIC SURFACES

(71) Applicant: THE CHINESE UNIVERSITY OF HONG KONG, Hong Kong (CN)

(72) Inventors: Ping Guo, Hong Kong (CN); Yang Yang, Hong Kong (CN)

(73) Assignee: THE CHINESE UNIVERSITY OF HONG KONG, Hong Kong (CN)

( * ) Notice: Subject to any disclaimer, the term of this patent is extended or adjusted under 35 U.S.C. 154(b) by 0 days.

(21) Appl. No.: 15/644,309

(22) Filed: Jul. 7, 2017

(65) Prior Publication Data

US 2018/0010253 A1 Jan. 11, 2018
US 2018/0179636 A9 Jun. 28, 2018
US 2018/0282873 A2 Oct. 4, 2018

Related U.S. Application Data

(60) Provisional application No. 62/360,086, filed on Jul. 8, 2016.

(51) Int. Cl.
*B44C 1/22* (2006.01)
*B44F 1/14* (2006.01)
(Continued)

(52) U.S. Cl.
CPC ..... *C23C 22/58* (2013.01); *B05D 7/14* (2013.01); *B44C 1/222* (2013.01); *B44F 1/14* (2013.01);
(Continued)

(58) Field of Classification Search
CPC ..... B44C 1/222; B44F 1/14
(Continued)

(56) References Cited

U.S. PATENT DOCUMENTS 2,701,417 A * 2/1955 Graham ..... B43L 13/024 33/18.1
4,805,312 A * 2/1989 Datwyler ..... B23Q 11/0032 33/18.1
(Continued)

FOREIGN PATENT DOCUMENTS

WO WO-0216149 A1 * 2/2002 ..... B44C 1/228

OTHER PUBLICATIONS

Bruzzone, A.A.G. et al., Advances in engineered surfaces for functional performance, CIRP Annals—Manufacturing Technology, 2008, 57(2):750-769, Elsevier.
(Continued)

*Primary Examiner* — Christopher W Fulton
(74) *Attorney, Agent, or Firm* — Saliwanchik, Lloyd & Eisenschenk

(57) ABSTRACT

Materials for, and methods of, colorizing a metallic surface with micro-gratings using vibration cutting technologies are provided. Micro-gratings on aluminum, brass, and stainless steel surfaces can be rapidly created to effect, under illumination, at least one color observable in the visible spectrum using elliptical vibration texturing, a vibration-assisted mechanical cutting process. The modified metallic surface can display multiple visible colors, an iridescent effect caused by changes in one or more cutting parameters employed to produce the micro-gratings, the angle of illumination by an incident light, and/or the viewing angle of the surface under illumination.

20 Claims, 5 Drawing Sheets

(51) Int. Cl.

| | |
|---|---|
| ***C23C 22/58*** | (2006.01) |
| ***C23C 22/57*** | (2006.01) |
| ***B05D 7/14*** | (2006.01) |
| ***C23C 22/53*** | (2006.01) |
| ***C23C 22/56*** | (2006.01) |

(52) U.S. Cl.
CPC ..... *C23C 22/53* (2013.01); *C23C 22/56* (2013.01); *C23C 22/57* (2013.01)

(58) Field of Classification Search
USPC ..... 33/18.1
See application file for complete search history.

(56) References Cited

U.S. PATENT DOCUMENTS

2012/0243094 A1* 9/2012 Boegli ..... B44B 5/026 359/567
2017/0297260 A1* 10/2017 Mantell ..... H04N 1/6088

OTHER PUBLICATIONS

Kinoshita, S. et al., Physics of structural colors, Reports on Progress in Physics, Jun. 6, 2008, 71(7):1-30, IOP Publishing Ltd.
Vorobyev, A.Y. et al., Colorizing metals with femtosecond laser pulses, Applied Physics Letters, 2008, 92(4):041914-1 to 041914-3, American Institute of Physics.
Wu, Qihong et al., Femtosecond laser-induced periodic surface structure on diamond film, Applied Physics Letters, Mar. 17, 2003, 82(11):1703-1705, American Institute of Physics.
Ahsan, MD. Shamim et al., Colorizing stainless steel surface by femtosecond laser induced micro/nano-structures, Applied Surface Science, Jun. 2011, 257(17):7771-7777, Elsevier B.V.
Dusser, B. et al., Controlled nanostructrures formation by ultra fast laser pulses for color making, Optics Express, Feb. 1, 2010, 18(3):2913-2924, Optical Society of America.
Ou, Zhigui et al., Colorizing pure copper surface by ultrafast laser-induced near-subwavelength ripples, Optical Express, Jul. 14, 2014, 22(14):17254-17265, Optical Society of America.
Moriwaki, Toshimichi et al., Ultrasonic Elliptical Vibration Cutting, CIRP Annals—Manufacturing Technology, 1995, 44(1):31-34, Elsevier.
Guo, Ping et al., An analysis of the surface generation mechanics of the elliptical vibration texturing process, International Journal of Machine Tools & Manufacture, Jan. 2013, 64:85-95, Elsevier Ltd.
Guo, Ping et al., Generation of hierarchical micro-structures for anisotropic wetting by elliptical vibration cutting, CIRP Annals—Manufacturing Technology, 2014, 63(1):553-556, Elsevier.
Guo, Ping et al., Fast Generation of Micro-Channels on Cylindrical Surfaces by Elliptical Vibration Texturing, Journal of Manufacturing Science and Engineering, Aug. 2014, 136(4):041008-1 to 041008-10, The American Society of Mechanical Engineering.
Guo, Ping et al., Development of a tertiary motion generator for elliptical vibration texturing, Precision Engineering, Apr. 2013, 37(2):364-371, Elsevier Inc.
Yang, Yang et al., Vibration analysis and development of an ultrasonic elliptical vibration tool based on a portal frame structure, Precision Engineering, Oct. 2017, 50:1-12, Elsevier Inc.
Yu, Haiwu et al., Geometric Shape Effects of Surface Texture on the Generation of Hydrodynamic Pressure Between Conformal Contacting Surfaces, Tribology Letters, 37(2):123-130, Springer.
Singh, Shyam, Diffraction gratings: aberrations and applications, Optics & Laser Technology, Apr. 1999, 31(3):195-218, Elsevier Science Ltd.
Lu, Yong et al., Experimental studies of wettability control on cylindrical surfaces by elliptical vibration texturing, The International Journal of Advanced Manufacturing Technology, Feb. 2015, 76(9-12):1807-1817, Springer London.
Bruzzone, A.A.G. et al., Advances in engineered surfaces for functional performance, CIRP Annals—Manufacturing Technology, 2008, 57(2):750-769, 2008 CIRP.
Dusser, B. et al., Controlled nanostructrures formation by ultra fast laser pulses for color marking, Optics Express, Feb. 1, 2010, 18(3):2913-2924, 2009 Optical Society of America.
Moriwaki, T. et al., Ultrasonic Elliptical Vibration Cutting, Annals of the CIRP, 1995, 44(1):31-34.
Guo, P. et al., Generation of hierarchical micro-structures for anisotropic wetting by elliptical vibration cutting, CIRP Annals—Manufacturing Technology, 2014, 63(1):553-556, 2014 CIRP.
Yu, H. et al., Geometric Shape Effects of Surface Texture on the Generation of Hydrodynamic Pressure Between Conformal Contacting Surfaces, Tribology Letters, 2010, 37(2):123-130, Springer Science+Business Media, LLC 2009.
Lu, Y. et al., Experimental studies of wettability control on cylindrical surfaces by elliptical vibration texturing, International Journal of Advanced Manufacturing Technology, 2015, 76:1807-1817, Springer-Verlag London 2014.

* cited by examiner

PRIOR ART

METHOD AND APPARATUS FOR STRUCTURAL COLORATION OF METALLIC SURFACES

CROSS-REFERENCE TO RELATED APPLICATION

This application claims the benefit of U.S. Provisional Application Ser. No. 62/360,086, filed Jul. 8, 2016, the disclosure of which is hereby incorporated by reference in its entirety, including all figures, tables and drawings.

BACKGROUND OF THE INVENTION

One existing technology used for generating colored metallic surfaces without using additional pigments is femtosecond or picosecond laser pulse writing, which produces laser-induced surface structures (LIPSSs) capable of engendering structural coloration on the metallic surfaces when illuminated by an incident light. These laser-induced, orderly surface patterns are spontaneously formed during laser irradiation (see, for example, FIG. 1). The orientation of the LIPSSs depends on the direction of the laser polarization, which is used to control the imprinted colors. For example, silver-white aluminum surfaces have been rendered to have gold, black, and grey colors by the laser-induced method.

LIPSSs, though highly reproducible, suffer from several drawbacks. First, it is challenging to predict and control the dimensions of the LIPSSs. Second, micro-gratings generated by LIPSSs are semi-regular, which adversely affects the efficiency of light diffraction and thus the colorization of the sample surface. Third, owing to material-specific laser-fluence, the effectiveness of coloration methods based on LIPSSs has not been verified for a wide variety of metallic surfaces. Fourth, the high cost of a femtosecond laser system and the long processing time (e.g., around 20 minutes for processing a 10 mm×10 mm copper sample) make the technology difficult to be adopted by industry for large-scale production.

BRIEF SUMMARY OF THE INVENTION

Due to the above-mentioned drawbacks, there remains a need in the art for developing effective and low-cost manufacturing processes to enhance the optical and physical properties of metallic surfaces.

Embodiments of the subject invention provide materials for, and methods of, colorizing a metallic surface with micro-gratings using vibration cutting technologies. In some embodiments, micro-gratings on aluminum, brass, stainless steel, and other common machinable metallic surfaces can be rapidly created to effect, under illumination, at least one color observable in the visible spectrum using elliptical vibration texturing, a vibration-assisted mechanical cutting process. In certain embodiments, the modified metallic surface can display multiple visible colors, an iridescent effect caused by changes in at least one of the following factors: one or more cutting parameters employed to produce the micro-gratings; the angle of illumination by an incident light; and the viewing angle of the surface under illumination.

Advantageously, technologies provided herein can enable efficient and low-cost manufacturing processes for enhancing the optical, physical, and aesthetic properties of metallic surfaces by creating periodic surface textures with controllable processing parameters. Further, by processing sample surfaces in accordance with embodiments provided herein, methods for preparing iridescent patterns, texts, and pictures on metallic surfaces can be readily realized. The iridescent color images with an optically variable effect textured on the metallic surface can be transferred to the ultrathin polymer film surface using replication manufacturing processes, such as injection molding or roll-to-roll/plate embossing process, which may find tremendous industrial applications in the anti-counterfeiting, product marking, and decoration fields.

DETAILED DISCLOSURE OF THE INVENTION

Embodiments of the subject invention provide novel and advantageous materials for, and methods of, colorizing a metallic surface with micro-gratings using vibration cutting technologies. In some embodiments, micro-gratings on metallic surfaces can be rapidly created to effect, under illumination, at least one color observable in the visible spectrum using elliptical vibration texturing (EVT), a vibration-assisted mechanical cutting process. In certain embodiments, the modified metallic surface can display multiple visible colors, an iridescent effect caused by changes in at least one of the following factors: one or more cutting parameters employed to produce the micro-gratings; the angle of illumination by an incident light; and the viewing angle of the surface under illumination.

In some embodiments, a method of treating a metallic surface comprises creating periodic and parallel (or substantially parallel) machine marks on the metallic surface with a cutting tool by vibrating the tool in a direction perpendicular (or approximately perpendicular) to the surface while displacing it across the surface. The periodic machine marks can provide the metallic surface with one or more structurally induced colors in the visible spectrum when the surface is illuminated. As used hereafter, the direction of vibration is designated the "depth-of-cut" direction, while the direction of displacement is designated the "cutting" direction.

In some embodiments, the metallic surface comprises one or more metals selected from aluminum, brass, titanium, zinc, magnesium, niobium, tantalum, iron, stainless steel, chromium, nickel, and alloys thereof. In certain embodiments, the metallic surface comprises materials that differ from the bulk of the sample on which the metallic surface overlays.

In some embodiments, the methods provided herein can reduce the quantitative roughness of the metallic surface as measured by any art-recognized surface metrology method.

In some embodiments, the vibration of the cutting tool is accomplished using an EVT method, which is a vibration-based mechanical texturing process. In a specific embodiment, the EVT method comprises inducing two-dimensional elliptical vibration of the cutting tool at a frequency less than or equal to the ultrasonic frequency. "Ultrasonic frequency" as used herein is defined as a frequency with a magnitude of at least 20 kHz. Advantageously, vibration-based processes provided herein significantly increase the efficiency in generating surface structures capable of inducing coloration of metallic surfaces when compared with existing laser-based processes. In an exemplary embodiment, the time required for processing a 10 mm×10 mm copper surface is approximately 5 minutes (or less) using the EVT method, whereas another copper sample of the same size requires approximately 20 minutes using a laser-based method such as, for example, laser pulse writing.

Figure 2:
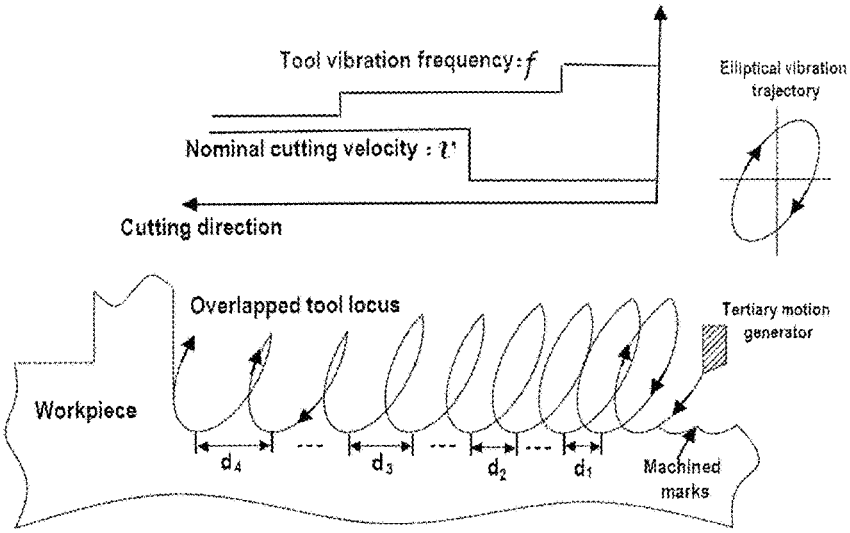
FIG. 2 shows a diagram illustrating the principle of the elliptical vibration texturing (EVT) method. The spacing distance, d, of the vibration-induced machined marks can be controlled by the nominal cutting velocity and the vibration frequency of the cutting tool according to an embodiment of the subject invention.

In some embodiments, when the nominal cutting velocity is smaller than the maximal vibration speed (i.e., $v<A_x\omega$), machine marks created by the cutting tool as it vibrates and moves across the metallic surface overlap due to the reverse motion of the tool tip with respect to the surface, as shown in FIG. 2. The machine marks, comprising periodic cusps, form orderly ripples across the surface, with the direction of each ripple being perpendicular to the cutting direction. The spacing d between adjacent ripples can be controlled with substantial precision in accordance with the following equation:

$$d = \frac{2\pi v}{\omega}. \tag{1}$$

Advantageously, Equation (1) provides that the spacing between periodic machine marks, i.e., the orderly ripples, can be varied simply by changing the velocity of the tool displacement in the cutting direction, i.e., the nominal cutting velocity v, while holding the vibration frequency constant, according to an embodiment of the subject invention. In another embodiment, the spacing between the periodic machine marks can be varied by changing the vibration frequency of the cutting tool, i.e., ω, while keeping the velocity of the tool displacement in the cutting direction constant.

Figure 3:
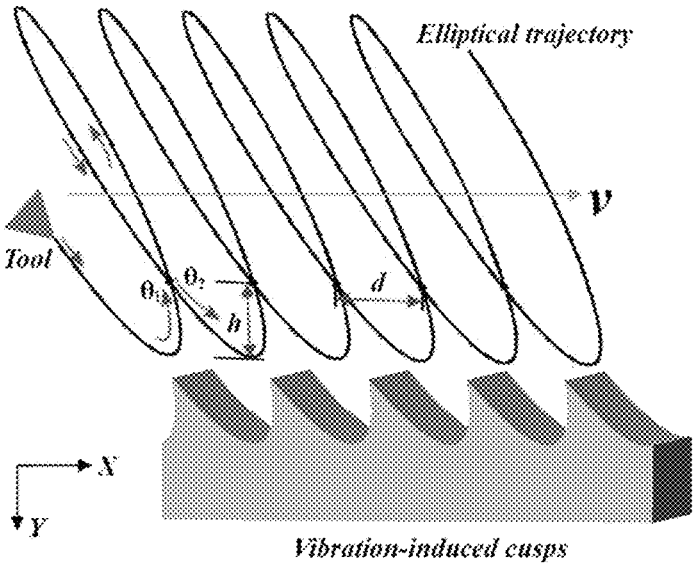
FIG. 3 shows a diagram illustrating the relationship between the tool vibration parameters and the geometry of vibration-induced cusps according to an embodiment of the subject invention.

Further, the coordinates of each cusp in the cutting direction satisfy the following equation:

$$A_x\cos\left(\frac{\theta_1+\theta_2}{2}\right)\sin\left(\frac{\theta_1-\theta_2}{2}\right)+\frac{v}{\omega}\left(\frac{\theta_1-\theta_2}{2}\right)=0, \tag{2}$$

where $\theta_1$ and $\theta_2$ are two particular angular positions of the tool tip having values between 0 and $2\pi$ that correspond to the coordinates of the cusps, as illustrated in FIG. 3. In some embodiments, the particular values of $\theta_1$ and $\theta_2$ can be solved numerically. In a particular embodiment, the height of each vibration-induced ripple, h, is subsequently determined by the height of the cusps with the equation (3):

$$h=A_y(1-|\sin(\theta_1+\varphi)|) \tag{3}.$$

Figure 4:
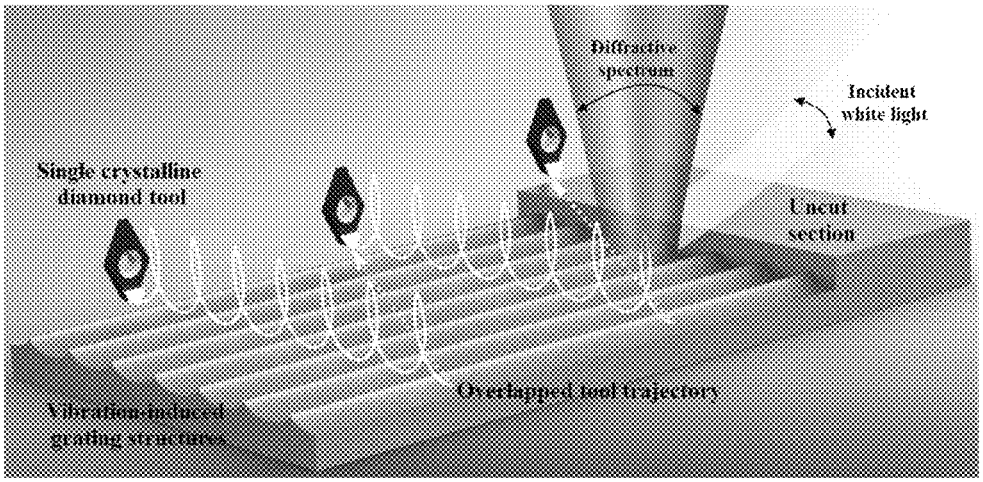
FIG. 4 shows a diagram illustrating the continuous vibration-induced ripples connected in the cross-feed direction by consecutive cut and the diffractive grating effect induced by the periodic ripples according to an embodiment of the subject invention.
Figure 5:
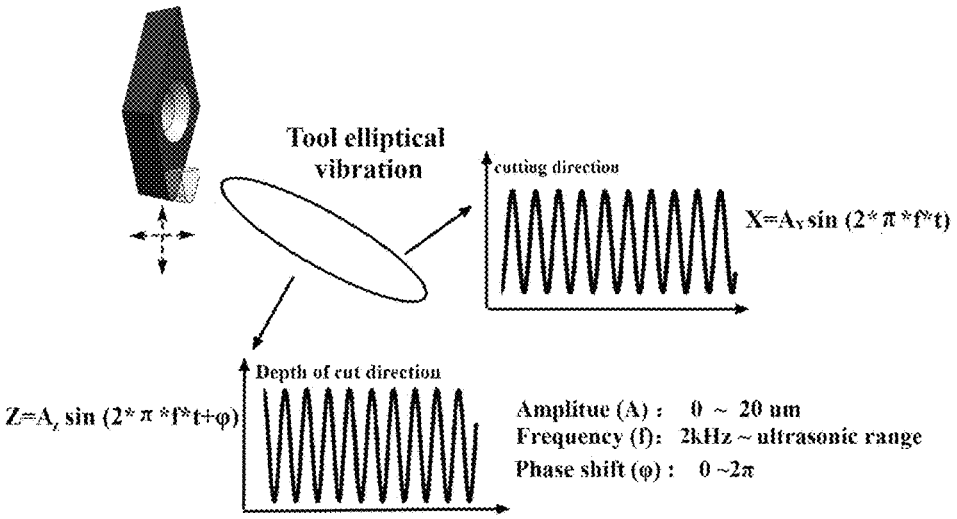
FIG. 5 shows a diagram of the 2D elliptical vibration trajectory of the cutting tool and the corresponding vibration performances in the depth of cut and cutting direction, as well as the achievable vibration parameters ranges according to an embodiment of the subject invention.

By sequentially cutting the metallic surface in parallel (or substantially parallel) micro-gratings, the vibration-induced ripples become connected and form continuous, long edges due to the overlapping of the machine marks in the cross-feed direction. The principle of the process is schematically is shown in FIG. 4. In some embodiments, the resonant vibration frequency of the cutting tool is predetermined to maximize vibration amplitudes and kept constant during the texturing process. As a result, the ripple spacing d between adjacent cusps can be determined and subsequently adjusted by changing the nominal cutting velocity v. In an embodiment, various values of spacing d can be obtained on a single metallic surface by tuning the nominal cutting velocity v as the cutting tool traverses across the surface.

Colors generated by the EVT-modified metallic surface methods provided herein can be attributed to the vibration-induced periodic and parallel (or substantially parallel) machine marks patterned on the metallic surfaces under various condition of illumination. In some embodiments, the wavelength of the light generated by optical reflection and diffraction from the machine marks depends upon a number of factors described by the equation below:

$$d(\sin\theta_i+\theta_m)=m\lambda \tag{4}$$

where d is the ripple spacing, m is an integer representing the order of diffraction, $\theta_i$ and $\theta_m$ are respectively the angle of illumination by the incident light and the angle of diffracted beams of order m, i.e., the viewing angle, and λ is the wavelength of the light diffracted by the machine marks on the metallic surface. A given value of λ corresponds to a specific color in the visible spectrum and is therefore subject to change in accordance with changes in other parameters of Equation (4). In an embodiment when the incident light is a white light and is perpendicular to the metallic surface, the viewing angle $\theta_m$ is given by the diffracted angle maxima in the following equation:

$$\theta_m = \arcsin\left(\frac{m\lambda}{d}-\sin\theta_i\right). \tag{5}$$

Advantageously, a combination of different cutting velocities can be applied to different regions of the same metallic surface, effectively generating various values of spacing d, and thus various values of λ, among the different regions. In some embodiments, the different regions of a metallic surface comprising different values of spacing d can form desired patterns such as, for example, texts and pictures, that comprise different colors when illuminated by an incident light and viewed from the same angle. Alternatively, due to the fact that the direction of the machine marks is perpendicular to the cutting direction, changes in the orientation of the EVT-modified metallic surface with respect to a given incident light can also effect changes in the appearance of colors when a fixed value of cutting velocity (i.e., value of spacing d) is employed during the texturing process. In a particular embodiment, metallic surfaces modified in accordance with the methods provided herein can display iridescent effects when viewed from different angles under a given incident light.

In an embodiment, the methods provided herein can be used to modify, texture, and colorize metallic surfaces of jewelry articles for which certain aesthetic properties such as, for example, iridescence, are desirable. In another embodiment, super-hydrophobic surfaces can be prepared in accordance with the methods described herein. Specifically, machine marks generated using the EVT method can form surface structures capable of preventing or inhibiting water molecules from adsorbing onto the metallic surfaces, enabling advancement in technical fields such as, for example, tribology, corrosion, self-cleaning, anti-fouling, and reduced drag for surfaces traveling through water, (for example, torpedoes, submarines, and surface hulls).

Embodiments of the subject invention also provide an apparatus for treating a metallic surface, the apparatus comprising components employed in an EVT process, including a tertiary motion generator mounted on an actuated stage, a cutting tool integrated to the elliptical motion generator, a linear motion actuator, and at least two displacement sensors for measuring the amplitudes of the elliptical vibration of the cutting tool.

In some embodiments, the ultrasonic elliptical motion generator is based on a portal frame structure. Specifically, the cutting tool integrated to the motion generator relies on the coupled resonant vibrations of the frame structure to achieve an elliptical cutting trajectory at an ultrasonic frequency (i.e., at least 20 kHz) at maximized amplitudes (see also Yang et al., Vibration analysis and development of an ultrasonic elliptical vibration tool based on a portal frame structure, 2017, *Precision Engineering*, in press; and Guo et al., Development of a tertiary motion generator for elliptical vibration texturing, *Precision Engineering,* 37(2), pp. 364-371, 2013), which is hereby incorporated by reference herein in its entirety).

In some embodiments, the cutting tool is selected according to the composition and eventual applications of the metallic surface in need of modification. Specifically, the geometry of the cutting tool is determined according to the dimensions of the periodic and parallel (or substantially parallel) machine marks desired for the surface modification. The material employed for the cutting tool depends upon factors such as, for example, the hardness of the metallic surface to be modified. In an embodiment, the cutting tool employs single-crystalline diamond with the highest hardness of any bulk material.

In an embodiment, the elliptical motion generator along with the cutting tool is mounted on a precision-controlled, three-axis actuated stage capable of manipulating and positioning the sample surface during the texturing process.

Advantageously, technologies provided herein can enable efficient and low-cost manufacturing processes for enhancing the optical, physical, and aesthetic properties of metallic surfaces by creating periodic surface textures with controllable processing parameters. Further, by processing sample surfaces in accordance with the embodiments provided herein, methods for preparing iridescent patterns, texts, and pictures on metallic surfaces can be readily realized.

A greater understanding of the present invention and of its many advantages may be had from the following examples, given by way of illustration. The following examples are illustrative of some of the methods, applications, embodiments and variants of the present invention. They are, of course, not to be considered as limiting the invention. Numerous changes and modifications can be made with respect to the invention.

The subject invention includes, but is not limited to, the following exemplified embodiments.

Embodiment 1

A method of modifying a metallic surface, the method comprising: creating with a cutting tool on the metallic surface at least one series of periodic features perpendicular to a desired cutting direction.

Embodiment 2

The method according to embodiment 1, wherein the at least one series of periodic features are parallel or substantially parallel and the cutting tool is vibrated at a distinct frequency while simultaneously displaced along the desired cutting direction across the metallic surface.

Embodiment 3

The method according to any of the embodiments 1-2, wherein a rate of the displacement of the cutting tool is different from the distinct frequency of the vibration of the cutting tool.

Embodiment 4

The method according to any of the embodiments 1-3, wherein the distinct value of frequency f is in a range of less than or equal to the ultrasonic range. "Ultrasonic range" as used herein is defined as a frequency with a magnitude of at least 20 kHz.

Embodiment 5

The method according to any of the embodiments 1-4, wherein the rate of the displacement of the cutting tool is less than the frequency of the vibration of the cutting tool.

Embodiment 6

The method according to any of the embodiments 1-5, wherein a spacing d between adjacent periodic features perpendicular to the desired cutting direction is defined by the equation:

$$d = \frac{2\pi v}{\omega},$$

wherein $v$ is the rate of the displacement of the cutting tool and $\omega$ is the angular frequency of the vibration of the cutting tool.

Embodiment 7

The method according to any of the embodiments 1-6, wherein the metallic surface comprises aluminum, brass, titanium, zinc, magnesium, niobium, tantalum, iron, stainless steel, chromium, nickel, or an alloy of any combination thereof.

Embodiment 8

The method according to any of the embodiments 1-7, wherein the metallic surface comprises aluminum, brass, or stainless steel.

Embodiment 9

The method according to any of the embodiments 1-8, wherein the cutting tool comprises single-crystalline diamond.

Embodiment 10

The method according to any of the embodiments 1-9, wherein the vibration of the cutting tool comprises by an elliptical trajectory having two orthogonal components with identical frequencies.

Embodiment 11

The method according to any of the embodiments 1-10, wherein the metallic surface is the surface of an article of jewelry.

Embodiment 12

A metallic surface prepared according to the method of any of the embodiments 1-11, capable of displaying light of a distinct value of wavelength λ, wherein the distinct value of the wavelength λ is determined by the equation:

$$d(\sin\theta_i+\theta_m)=m\lambda,$$

wherein d is the spacing distance between adjacent periodic features perpendicular to the desired cutting direction, $\theta_i$ is an angle of illumination by an incident light, $\theta_m$ is an angle of viewing, and m is an integer indicating the order of diffraction of the incident light by the periodic features.

Embodiment 13

The metallic surface according to embodiment 12, wherein the spacing distance d is in a range of from 300 nm to 2000 nm.

Embodiment 14

The metallic surface according to any of the embodiments 12-13, wherein the distinct value of the wavelength λ is in a range of from 380 nm to 750 nm.

Embodiment 15

A method of producing an iridescent metallic surface, the method comprising:

defining on the metallic surface a plurality of distinct regions of the same or different shapes and sizes, the number of distinct regions corresponding to a number of colors desired for the iridescent metallic surface to display.

Embodiment 16

The method according to embodiment 15 comprising creating with a cutting tool on a first distinct region of the metallic surface at least one series of periodic features perpendicular to the desired cutting direction, wherein the at least one series of periodic features are parallel or substantially parallel, wherein the cutting tool is vibrated at a distinct frequency while simultaneously displaced along a desired cutting direction across the metallic surface, and wherein a rate of the displacement of the cutting tool is different from the frequency of the vibration of the cutting tool.

Embodiment 17

The method according to any of the embodiments 15-16 further comprising repeating the treatment of the first distinct region of the metallic surface in each additional region of the metallic surface, wherein the frequency of the vibration of the cutting tool is held constant while the rate of the displacement of the cutting tool varies from each distinct region to each other distinct region of the metallic surface, or wherein the rate of the displacement of the cutting tool is held constant while the frequency of the vibration of the cutting tool varies from each distinct region to each other distinct region of the metallic surface.

Embodiment 18

The method according to any of the embodiments 15-17, wherein the rate of the displacement of the cutting tool is less than the frequency of the vibration of the cutting tool.

Embodiment 19

The method according to any of the embodiments 15-18, wherein the spacing d between adjacent periodic features perpendicular to the desired cutting direction is defined by the equation:

$$d=\frac{2\pi v}{\omega},$$

wherein ν is the rate of the displacement of the cutting tool and ω is the a angular frequency of the vibration of the cutting tool.

Embodiment 20

The method according to any of the embodiments 15-19, wherein the metallic surface comprises aluminum, brass, titanium, zinc, magnesium, niobium, tantalum, iron, stainless steel, chromium, nickel, or an alloy of any combination thereof.

Embodiment 21

The method according to any of the embodiments 15-20, wherein the metallic surface comprises aluminum, brass, or stainless steel.

Embodiment 22

The method according to any of the embodiments 15-21, wherein the cutting tool comprises single-crystalline diamond.

Embodiment 23

The method according to any of the embodiments 15-22, wherein the vibration of the cutting tool comprises an elliptical trajectory having two orthogonal components with identical frequencies.

Embodiment 24

The method according to any of the embodiments 15-23, wherein the metallic surface is the surface of an article of jewelry.

Embodiment 25

A metallic surface prepared according to any of the embodiments 19-24, capable of displaying light having at least one distinct value of wavelength λ, wherein the number of the at least one distinct values of λ is determined by the number of the distinct regions defined on the metallic surface, and wherein each of the at least one distinct value of λ is determined by the equation:

$$d(\sin\theta_i+\theta_m)=m\lambda,$$

wherein d is the spacing distance between adjacent periodic features in the desired cutting direction, $\theta_i$ is the angle of illumination by an incident light, $\theta_m$ is the angle of viewing, and m is an integer indicating the order of diffraction of the incident light.

Embodiment 26

The metallic surface according to embodiment 25, wherein the spacing distance d is in a range of from 300 nm to 2000 nm.

Embodiment 27

The metallic surface according to embodiment 25, displaying light of at least one distinct value of wavelength λ, wherein each of the at least one distinct value of wavelength λ is in a range of from 380 nm to 750 nm.

Embodiment 28

An apparatus for treating a metallic surface, the apparatus comprising:

an actuated stage;

a motion generator mounted on the actuated stage, the motion generator being capable of engaging a cutting tool integrated therein in sinusoidal vibrating motion with the metallic surface at an adjustable frequency less than or equal to the ultrasonic range in magnitude;

a linear motion actuator capable of displacing the vibrating cutting tool across the metallic surface; and at least two displacement sensors each capable of measuring the amplitude of the vibration of the cutting tool.

A greater understanding of the present invention and of its many advantages may be had from the following examples, given by way of illustration. The following examples are illustrative of some of the methods, applications, embodiments and variants of the present invention. They are, of course, not to be considered as limiting the invention. Numerous changes and modifications can be made with respect to the invention.

Example 1

A pre-tuning process was performed such that the elliptical motion generator achieved the optimal vibration performance for the texturing process. For the purpose of evaluating the dynamic performance of the motion generator, two capacitance displacement sensors were adopted and integrated into the machine setup to measure the vibration trajectory of the cutting insert. The motion generator was mounted on the Aerotech linear motion actuator (ACT115DL). The linear motion actuator provides the cutting motion (x-axis) during the texturing process. The resolution and repeatability of the linear motion actuator were 100 nm and 1 um, respectively. The excitation voltage signals applied to the motion generator were generated by a dual-channel function generator and then sent to a piezo amplifier (TREK PZD350A), which has a high bipolar voltage output of up to ±350V. Two capacitance displacement sensors from Microsense (Model 5501) were used to monitor the vibration trajectories of the tool tip. Each of the sensors was fixed on the workbench using a magnetic base. The response signals from the sensors were transmitted to a National Instrument data acquisition card (NI DAQ PCIe-6361) for data processing.

During the pre-tuning process, the voltage amplitudes applied to the tertiary motion generator were ±200 V. The driven frequency of the two sinusoidal signals were both set at 28.0 kHz, while the phase difference between the two excitation signals was 180° to achieve the largest vibration amplitude in the depth-of-cut direction. The peak-to-peak vibration amplitudes in the depth-of-cut and cutting directions were tuned at 5.0 μm and 3.0 μm, respectively. All the driven parameters for the motion generator were kept constant for the following coloration process. In the meantime, the vibration performance of the cutting tool was evaluated from time to time to ensure consistent vibration trajectory for the coloration process. Stainless steel, brass and aluminum alloy were chosen as the exemplary metallic workpiece for demonstration. The workpiece was screwed to an acrylic adaptor, which was mounted on an Aerotech X-Y-Z motion stage (ANT130-060-L Series). The resolution and repeatability of each axis can reach 1 nm and 75 nm, respectively. The three-axis motion stage set the depth-of-cut (z-axis) and the cross-feed motion (y-axis) during the texturing process. A single-crystalline diamond cutting tool was employed in the texturing process, whose nose radius was approximately 500 μm. The rake and clearance angles of the cutting tool were 0° and 12°, respectively. The entire setup of the EVT process was stationed on a vibration isolation table and controlled by an A3200 control system.

Example 2

Specific sizes and geometries of the surface structures are determined by factors such as, for example, processing parameters, geometry of the cutting tool, and strength of the excitation signals. The particular processing parameters such as, for example, nominal cutting velocity, cross feed, and nominal depth-of-cut, require careful considerations when the geometry and the vibration frequency of the tool were fixed during the coloration process. Nominal cutting velocity was selected to ensure that the ripple spacing was located in the visible spectrum. Cross feed was set to link the cusps in the cross-feed direction to form incessant ripples, while the nominal depth-of-cut was set to control the height of induced cusps. After the texturing process was completed, the samples were cleaned in an ultrasonic cleaner at 50° C. for 10 minutes. The surface topographies of textured structures were then examined using a JEOL scanning electronic microscope (JSM-7800F) with an acceleration voltage of 10 kV. The height profile of vibration-induced structures was investigated with a Multimode atomic force microscope (AFM) in contact mode.

Example 3

Figure 6:
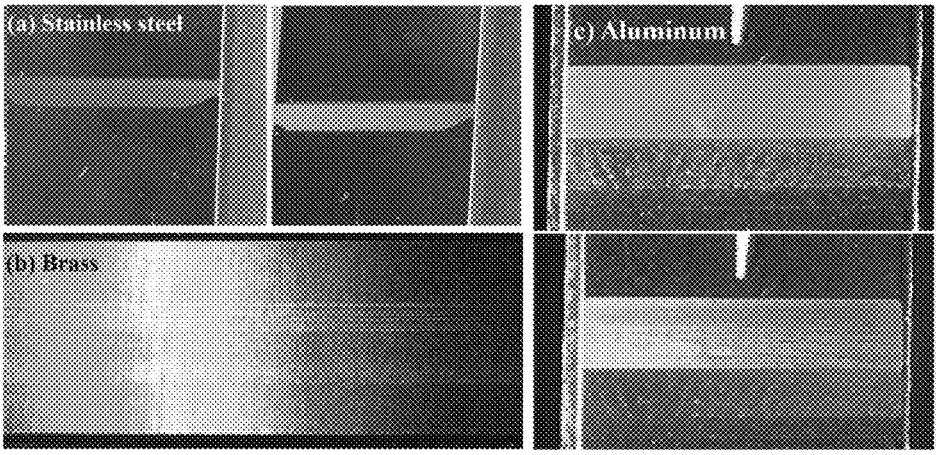
FIG. 6 shows an image showing the grating effects on multi-material surfaces, e.g. stainless steel (00Cr19Ni10), brass (H61), and aluminum (Al6061) surface, after surface modification.

Preliminary colorized results with iridescent effects on the stainless steel, brass, and aluminum alloy surface were achieved, as shown in FIG. 6. The cross-feed and the nominal depth-of-cut were kept constant for all material, at 50 μm and 0 μm, respectively. The nominal cutting velocities exerted on these three metallic surfaces were set at 22.4 mm/s, 42.0 mm/s, and 14.0 mm/s, respectively. The corresponding ripple spacing was 800 nm, 1500 nm, and 500 nm for the stainless steel, brass and the aluminum alloy surfaces, respectively according to Equation (1). The spacing between the elliptical vibration-induced ripples was varied from the visible spectrum to the infrared spectrum. Due to its intrinsic mechanism of the elliptical vibration texturing (EVT) method, materials with different machinability show almost remarkable iridescent effect demonstrating the capability of the proposed coloration process for colorizing all kinds of metals.

Example 4

Figure 1:
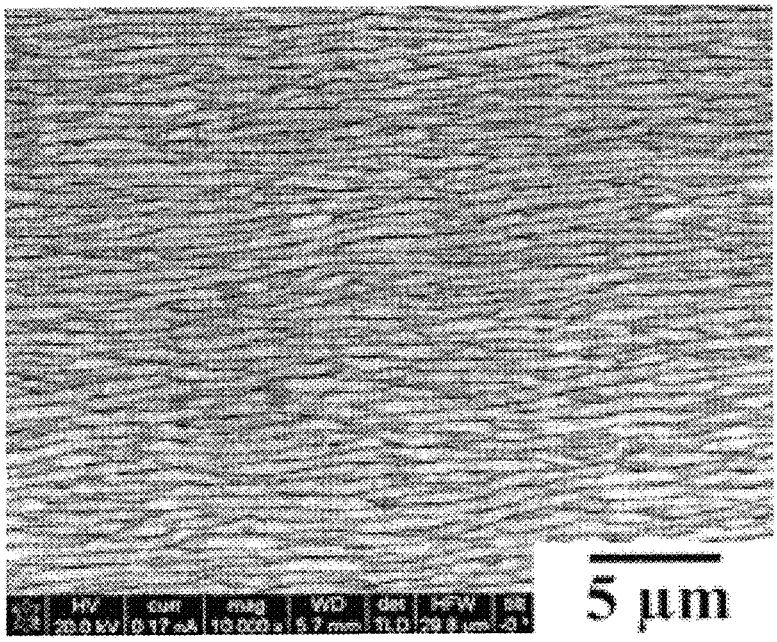
FIG. 1 shows an SEM image of exemplary laser induced periodic surface structures (LIPSSs) according to the prior art.
Figure 7:
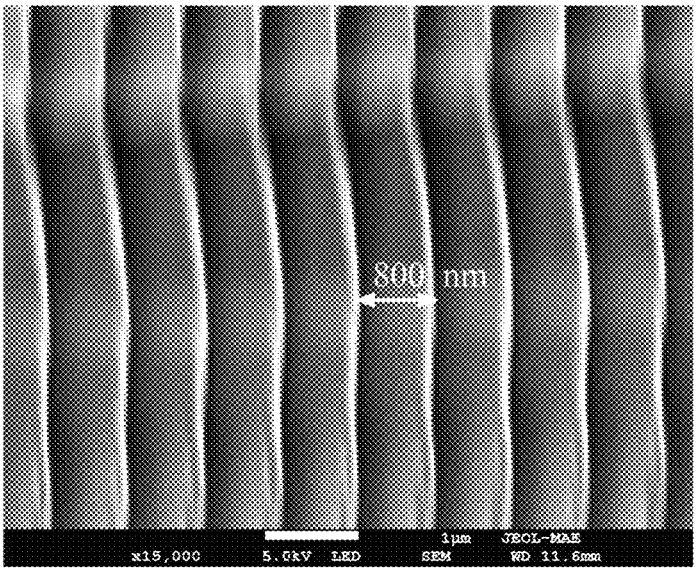
FIG. 7 shows a scanning electron microscope (SEM) micrograph of typical vibration-induced ripple structures with a spacing distance of 800 nm according to an embodiment of the subject invention.

To verify the surface morphology of the iridescent surface, the stainless steel surface was studied using a scanning electronic microscope (SEM). As can be seen from the SEM micrographs in FIG. 7, highly regular periodic cusps along the cutting direction were clearly identified on the micrographs. In the cross-feed direction, the ripples were connected forming incessant long edges due to the overlapping in the cutting path in the cross-feed direction. Compared with the laser-induced periodic surface structures in FIG. 1, the periodic ripples generated by the EVT process were more controlled and regular, as shown FIG. 7, thus resulting in enhanced colorization effect. Besides the height value of the vibration-induced ripples lies in the range from several tens of nanometers to several hundred nanometers, which demonstrates the significant reduction of roughness of the as-received metallic surface. Surface structures obtained from vibration-induced cutting methods provided herein possess impressive resolution, which can enable applications in fields such as, for example, wavelength selectors, pattern recognition, and metrology (see also Singh (Diffraction gratings: aberrations and applications, *Optics & Laser Technology,* 31(3), 195-218, 1999, which is hereby incorporated by reference herein in its entirety).

Example 5

Figure 8:
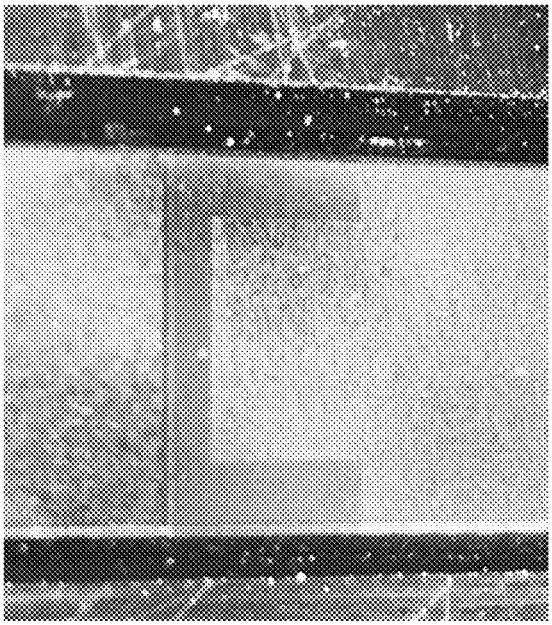
FIG. 8 shows an image showing of a green letter C with a gold background on a brass surface (H61), after surface modification, viewed from a specific angle.
Figure 9:
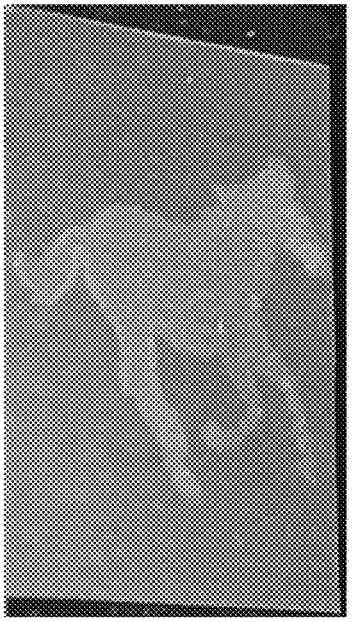
FIG. 9 shows an image showing of a green horse with a blue background on a brass surface (H61), after surface modification, viewed from a specific angle.
Figure 10:
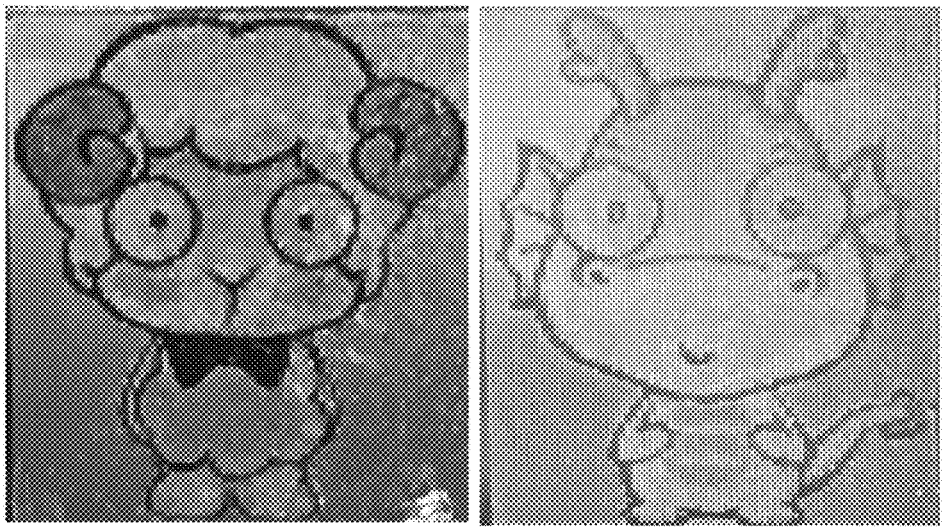
FIG. 10 shows two images that demonstrate the capability of the EVT method to generate arbitrary complex images using vibration-induced ripples with various spacing distances on brass surfaces (H61), viewed from a specific angle according to an embodiment of the subject invention.

The proposed EVT process provides the flexibility for generating arbitrary patterns and images with iridescent effect on the metallic surfaces. The spacing distance of the elliptical vibration-induced ripple, as a key factor to influence the apparent color was determined by the nominal cutting velocity. Image regions with different apparent colors can be assigned ripples structures with different spacing distances. As an example, a green letter C with a gold background on a brass surface viewed from a specific angle was fabricated as shown in FIG. 8. The ripple spacing distances assigned for the letter region and the background region were 500 nm and 750 nm, respectively. The corresponding nominal cutting velocities for the letter and background region were 14.0 mm/s and 21.0 mm/s, respectively. In addition, a color silhouette of a galloping horse was selected and textured on a brass surface, as shown in FIG. 9. During the coloration process, the background and the silhouette image regions were assigned with grating structures with a wavelength of 1000 nm and 750 nm, respectively. That is to say, the cutting speeds were set at 28.0 mm/s and 21.0 mm/s respectively for the background and image regions.

Example 6

Since the nominal cutting velocity profile can be easily programmed in G-code, high-resolution and complex patterns can be generated accordingly. For example, colorful animal image were textured using eight different grating spacing values. The designed resolution, or single pixel size, was 80×80 μm, which could not be discernible by human eyes at a normal viewing distance. The RGB values of the original image were taken and categorized into 8 different levels. The 8 levels were evenly distributed between 500 nm to 1000 nm in terms of the grating spacing distance, which meant that a 0 RGB value corresponded to 500 nm; while a 255 RGB value was assigned to 1000 nm.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein (including those in the "References" section) are incorporated by reference in their entirety, including all figures and tables, to the extent they are not inconsistent with the explicit teachings of this specification.

REFERENCES

[1] Bruzzone, A., Costa, H., Lonardo, P., and Lucca, D., 2008, "Advances in engineered surfaces for functional performance," CIRP Annals-Manufacturing Technology, 57(2), pp. 750-769.

[2] Kinoshita, S., Yoshioka, S., and Miyazaki, J., 2008, "Physics of structural colors," Reports on Progress in Physics, 71(7), p. 076401.

[3] Vorobyev, A. Y., and Guo, C., 2008, "Colorizing metals with femtosecond laser pulses," Applied Physics Letters, 92(4), p. 041914.

[4] Wu, Q., Ma, Y., Fang, R., Liao, Y., Yu, Q., Chen, X., and Wang, K., 2003, "Femtosecond laser-induced periodic surface structure on diamond film," Applied Physics Letters, 82(11), pp. 1703-1705.

[5] Ahsan, M. S., Ahmed, F., Kim, Y. G., Lee, M. S., and Jun, M. B., 2011, "Colorizing stainless steel surface by femtosecond laser induced micro/nano-structures," Applied surface science, 257(17), pp. 7771-7777.

[6] Dusser, B., Sagan, Z., Soder, H., Faure, N., Colombier, J.-P., Jourlin, M., and Audouard, E., 2010, "Controlled nanostructrures formation by ultra fast laser pulses for color marking," Optics express, 18(3), pp. 2913-2924.

[7] Ou, Z., Huang, M., and Zhao, F., 2014, "Colorizing pure copper surface by ultrafast laser-induced near-subwavelength ripples," Optics express, 22(14), pp. 17254-17265.

[8] Moriwaki, T., and Shamoto, E., 1995, "Ultrasonic elliptical vibration cutting," CIRP Annals-Manufacturing Technology, 44(1), pp. 31-34.

[9] Guo, P., and Ehmann, K. F., 2013, "An analysis of the surface generation mechanics of the elliptical vibration texturing process," International Journal of Machine Tools and Manufacture, 64, pp. 85-95.

[10] Guo, P., Lu, Y., Ehmann, K. F., and Cao, J., 2014, "Generation of hierarchical micro-structures for anisotropic wetting by elliptical vibration cutting," CIRP Annals-Manufacturing Technology, 63(1), pp. 553-556.

[11] Guo, P., Lu, Y., Pei, P., and Ehmann, K. F., 2014, "Fast generation of micro-channels on cylindrical surfaces by elliptical vibration texturing," Journal of Manufacturing Science and Engineering, 136(4), p. 041008.

[12] Guo, P., and Ehmann, K. F., 2013, "Development of a tertiary motion generator for elliptical vibration texturing," Precision Engineering, 37(2), pp. 364-371.

[13] Yang, Y., Gao, S., Chen K., Pan Y., and Guo, P., 2017 "Vibration analysis and development of an ultrasonic elliptical vibration tool based on a portal frame structure" Precision Engineering, in press.

[14] Yu, H., Wang, X., and Zhou, F., 2010, "Geometric shape effects of surface texture on the generation of hydrodynamic pressure between conformal contacting surfaces," Tribology Letters, 37(2), pp. 123-130.

[15] Singh, S. (1999). Diffraction gratings: aberrations and applications. Optics & Laser Technology, 31(3), 195-218.

[16] Y Lu, P. Guo, P. Pei, and K. Ehmann, "Experimental Studies of Wettability Control on Cylindrical Surfaces by Elliptical Vibration Texturing," The International Journal of Advanced Manufacturing Technology, 2015, 76(9), p. 1807-1817.

What is claimed is:

1. A method of producing an iridescent metallic surface, the method comprising:

defining on the metallic surface a plurality of distinct regions of the same or different shapes and sizes, wherein a number of distinct regions corresponds to a number of colors desired for the iridescent metallic surface to display;

creating with a cutting tool on a first distinct region of the metallic surface at least one series of periodic features perpendicular to a desired cutting direction, wherein the at least one series of periodic features are parallel or substantially parallel, wherein the cutting tool is vibrated at a distinct frequency while simultaneously displaced along the desired cutting direction across the metallic surface, and wherein a rate of the displacement of the cutting tool is different from the distinct frequency of the vibration of the cutting tool; and repeating the treatment of the first distinct region of the metallic surface in each additional region of the metallic surface, wherein the distinct frequency of the vibration of the cutting tool is held constant while the rate of the displacement of the cutting tool varies from each distinct region to each other distinct region of the metallic surface, or wherein the rate of the displacement of the cutting tool is held constant while the distinct frequency of the vibration of the cutting tool varies from each distinct region to each other distinct region of the metallic surface.

2. The method according to claim 1, wherein the rate of the displacement of the cutting tool is less than the distinct frequency of the vibration of the cutting tool.

3. The method according to claim 1, wherein a spacing d between adjacent periodic features perpendicular to the desired cutting direction is defined by the equation:

$$d = \frac{2\pi v}{\omega}$$

wherein ν is the rate of the displacement of the cutting tool and ω is an angular frequency of the vibration of the cutting tool.

4. A metallic surface prepared according to claim 3, capable of displaying light having at least one distinct value of wavelength λ, wherein the number of the at least one distinct values of λ is determined by the number of the distinct regions defined on the metallic surface, and wherein each of the at least one distinct value of λ is determined by the equation:

$$d(\sin\theta_i+\theta_m)=m\lambda,$$

wherein d is the spacing distance between adjacent periodic features in the desired cutting direction, $\theta_i$ is an angle of illumination by an incident light, $\theta_m$ is an angle of viewing, and m is an integer indicating the order of diffraction of the incident light.

5. The metallic surface according to claim 4, wherein the spacing distance d is in a range of from 300 nm to 2000 nm.

6. The metallic surface according to claim 4, displaying light of at least one distinct value of wavelength λ, wherein each of the at least one distinct value of wavelength A is in a range of from 380 nm to 750 nm.

7. The method according to claim 1, wherein the metallic surface comprises aluminum, brass, titanium, zinc, magnesium, niobium, tantalum, iron, stainless steel, chromium, nickel, or an alloy of any combination thereof.

8. The method according to claim 1, wherein the cutting tool comprises single-crystalline diamond.

9. The method according to claim 1, wherein the vibration of the cutting tool comprises an elliptical trajectory having two orthogonal components with identical frequencies.

10. The method according to claim 1, wherein a value of the distinct frequency is in a range of less than or equal to the ultrasonic range.

11. The method according to claim 10, wherein the rate of the displacement of the cutting tool is less than the distinct frequency of the vibration of the cutting tool.

12. The method according to claim 10, wherein a spacing d between adjacent periodic features perpendicular to the desired cutting direction is defined by the equation:

$$d = \frac{2\pi v}{\omega},$$

wherein ν is the rate of the displacement of the cutting tool and ω is an angular frequency of the vibration of the cutting tool.

13. The method according to claim 10, wherein the metallic surface comprises aluminum, brass, titanium, zinc, magnesium, niobium, tantalum, iron, stainless steel, chromium, nickel, or an alloy of any combination thereof.

14. The method according to claim 10, wherein the cutting tool comprises single-crystalline diamond.

15. The method according claim 10, wherein the vibration of the cutting tool comprises an elliptical trajectory having two orthogonal components with identical frequencies.

16. A metallic surface prepared according to the method of claim 10, capable of displaying light of a distinct value of wavelength λ, wherein the distinct value of the wavelength λ is determined by the equation:

$$d(\sin\theta_i+\theta_m)=m\lambda,$$

wherein d is a spacing distance between adjacent periodic features perpendicular to the desired cutting direction, $\theta_i$ is an angle of illumination by an incident light, $\theta_m$ is an angle of viewing, and m is an integer indicating the order of diffraction of the incident light by the periodic features.

17. The metallic surface according to claim 16, wherein the spacing distance d is in a range of from 300 nm to 2000 nm.

18. The metallic surface according to claim 16, wherein the distinct value of the wavelength $\lambda$ is in a range of from 380 nm to 750 nm.

19. The method according to claim 10, wherein the metallic surface comprises aluminum, brass, or stainless steel.

20. The method according to claim 1, wherein the metallic surface comprises aluminum, brass, or stainless steel.

* * * * *